US010208273B2

(12) United States Patent
Khan et al.

(10) Patent No.: US 10,208,273 B2
(45) **Date of Patent: *Feb. 19, 2019**

(54) DRAIN FORMULATION FOR ENHANCED HAIR DISSOLUTION

(71) Applicant: THE CLOROX COMPANY, Oakland, CA (US)

(72) Inventors: Rashda Khan, Goleta, CA (US); Daniela Fritter, Pleasanton, CA (US); Lorinda Alcantara, Pleasanton, CA (US); Wenyu Zhang, Pleasanton, CA (US); Miranda Helmer, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/289,490

(22) Filed: Oct. 10, 2016

(65) Prior Publication Data

US 2017/0022454 A1 Jan. 26, 2017

Related U.S. Application Data

(63) Continuation-in-part of application No. 13/950,140, filed on Jul. 24, 2013, now Pat. No. 9,487,742.
(Continued)

(51) Int. Cl.
*C11D 1/14* (2006.01)
*C11D 1/22* (2006.01)
(Continued)

(52) U.S. Cl.
CPC ..... *C11D 3/3951* (2013.01); *C11D 1/14* (2013.01); *C11D 1/83* (2013.01); *C11D 3/044* (2013.01);
(Continued)

(58) Field of Classification Search
CPC ..... C11D 1/75; C11D 3/044; C11D 3/2079; C11D 3/30; C11D 3/3951; C11D 3/3953; C11D 3/3956; C11D 1/14; C11D 1/22
(Continued)

(56) References Cited

U.S. PATENT DOCUMENTS 3,684,722 A 8/1972 Hynam et al.
3,697,431 A 10/1972 Summerfelt
(Continued)

FOREIGN PATENT DOCUMENTS

EP 0129980 A2 2/1985
EP 0256638 B1 2/1988
(Continued)

OTHER PUBLICATIONS

Non-Final U.S. Office Action dated Nov. 2, 2015—PTO-892 Notice of References Cited, U.S. Appl. No. 13/950,140, filed Jul. 24, 2013.
(Continued)

*Primary Examiner* — Gregory R Delcotto
(74) *Attorney, Agent, or Firm* — Erin Collins

(57) ABSTRACT

The invention relates to drain cleaning compositions including relatively high concentrations of a hypochlorite oxidizing agent and a hydroxide (e.g., 4 to 12% and 2.5 to 10%, respectively. The composition further includes a surfactant (e.g., a surfactant blend, water, and exhibits a very high pH (e.g., at least 13). The composition is monophasic, even at high oxidizing and hydroxide concentrations. The surfactant may include a blend of an uncharged surfactant (e.g., an amphoteric surfactant or nonionic surfactant) and a charged surfactant (e.g., anionic, cationic, or a surfactant that becomes so under the high pH conditions of the composition). The ratio of charged to uncharged surfactant may be at least 1:10, e.g., from 1:10 to about 1:50.

15 Claims, 10 Drawing Sheets

Related U.S. Application Data

(60) Provisional application No. 61/698,988, filed on Sep. 10, 2012.

(51) Int. Cl.

| | |
|---|---|
| ***C11D 1/75*** | (2006.01) |
| ***C11D 3/395*** | (2006.01) |
| ***C11D 3/30*** | (2006.01) |
| ***C11D 3/20*** | (2006.01) |
| ***C11D 3/04*** | (2006.01) |
| ***C11D 1/83*** | (2006.01) |
| ***C11D 10/04*** | (2006.01) |
| *C11D 1/29* | (2006.01) |

(52) U.S. Cl.
CPC ..... *C11D 3/2079* (2013.01); *C11D 3/30* (2013.01); *C11D 3/3953* (2013.01); *C11D 3/3956* (2013.01); *C11D 10/042* (2013.01); *C11D 10/045* (2013.01); *C11D 1/22* (2013.01); *C11D 1/29* (2013.01); *C11D 1/75* (2013.01)

(58) Field of Classification Search
USPC ..... 510/191, 195, 238, 380, 433, 488, 503, 510/426, 427, 428
See application file for complete search history.

(56) References Cited

U.S. PATENT DOCUMENTS

| | | | | |
|---|---|---|---|---|
| 4,282,109 | A | 8/1981 | Citrone et al. | |
| 4,474,677 | A | 10/1984 | Foxlee | |
| 4,783,283 | A | 11/1988 | Stoddart | |
| 4,900,467 | A | 2/1990 | Smith | |
| 5,011,538 | A | 4/1991 | Smith | |
| 5,034,150 | A | 7/1991 | Smith | |
| 5,055,219 | A | 10/1991 | Smith | |
| 5,336,426 | A | 8/1994 | Rader et al. | |
| 5,389,157 | A | 2/1995 | Smith | |
| 5,462,689 | A | 10/1995 | Choy | |
| 5,549,842 | A | 8/1996 | Chang | |
| 5,688,435 | A | 11/1997 | Chang et al. | |
| 5,688,756 | A | 11/1997 | Garabedian, Jr. et al. | |
| 5,804,545 | A | 9/1998 | Hemling et al. | |
| 5,916,859 | A | 6/1999 | Choy | |
| 5,972,866 | A | 10/1999 | Ahmed | |
| 6,100,228 | A | 8/2000 | Argo et al. | |
| 6,291,411 | B1 | 9/2001 | Callaghan et al. | |
| 6,756,352 | B2 | 6/2004 | Makansi | |
| 6,815,403 | B1 | 11/2004 | Laney | |
| 6,825,159 | B2 | 11/2004 | Man et al. | |
| 7,307,052 | B2 | 12/2007 | Murthy et al. | |
| 7,390,775 | B2 | 6/2008 | Rees et al. | |
| 9,487,742 | B2 * | 11/2016 | Khan | C11D 17/0026 |
| 2003/0199411 | A1 | 10/2003 | Ajamani et al. | |
| 2005/0079990 | A1 | 4/2005 | Chan et al. | |
| 2006/0247151 | A1 | 11/2006 | Kaaret et al. | |
| 2007/0093401 | A1 | 4/2007 | Murthy | |
| 2008/0221005 | A1 | 9/2008 | Kaaret et al. | |
| 2008/0227682 | A1 | 9/2008 | Chi-Cheng Feng et al. | |
| 2011/0180101 | A1 | 7/2011 | Konishi et al. | |
| 2011/0180619 | A1 | 7/2011 | Konishi et al. | |
| 2012/0111743 | A1 | 5/2012 | Kramer et al. | |
| 2013/0035277 | A1 | 2/2013 | Silvernail et al. | |
| 2014/0073546 | A1 * | 3/2014 | Khan | C11D 17/0026 510/195 |

FOREIGN PATENT DOCUMENTS

| | | | |
|---|---|---|---|
| EP | 1416038 | B1 | 3/2007 |
| EP | 1685228 | B1 | 11/2008 |
| WO | 9503381 | A1 | 2/1995 |
| WO | 2005049779 | A1 | 6/2005 |

OTHER PUBLICATIONS

Non-Final U.S. Office Action dated Oct. 7, 2014—PTO-892 Notice of References Cited, U.S. Appl. No. 13/950,140, filed Jul. 24, 2013.
PCT Search Report, PCT./US13/57338, The Clorox Compan; dated Jan. 7, 2014; 4 pages.

* cited by examiner

| Component | Ex. 11A | Ex.11B | Ex. 11C | Ex. 11D | Ex. 11E | Ex. 11F | Ex. 11G | Ex. 11H | Ex. 11I | Ex.11J |
|---|---|---|---|---|---|---|---|---|---|---|
| LO | | | 0.64 | 0 | 0 | 5.7 | 0.88 | 0 | 0 | 1.62 |
| MO | | | 1.91 | 2.55 | 2.7 | 0 | 3.54 | 3.49 | 3.49 | 3.78 |
| CFA | | | 0.45 | 0.45 | 0.3 | 0.3 | 0.78 | 0.615 | 0.615 | 0.6 |
| CFA/AO | | | 1:5.7 | 1:5.7 | 1:9 | 1:19 | 1:5.7 | 1:5.7 | 1:5.7 | 1:9 |
| NaOH | 18.85 | 3.2 | 3.6 | 3 | 8 | 11 | 3.6 | 3 | 2.68 | 7 |
| NaOCl | 7.95 | 12 | 7.95 | 5 | 4.56 | 5 | 7.95 | 5 | 8.19 | 7 |
| ZSV at 25°C | | | 2900 | 3600 | 1780 | 1160 | 7550 | 5990 | 7400 | 5170 |
| Tc (°C) | | | 60 | 66 | 38 | 61 | 64 | 70 | 59 | 58 |
| Corrositex Time (min) | 4:22 | 4:00 | 11:29 | 14:06 | 11:33 | 10:55 | 11:41 | 14:32 | 13:38 | 11:37 |
| Packaging Group | 1 | 1 | 2 | 2 | 2 | 2 | 2 | 2 | 2 | 2 |

*FIG. 9*

DRAIN FORMULATION FOR ENHANCED HAIR DISSOLUTION

CROSS-REFERENCE TO RELATED APPLICATIONS

The present application claims the benefit of U.S. Provisional Patent Application Ser. No. 61/698,988, filed on Sep. 10, 2012, and U.S. patent application Ser. No. 13/950,140, filed on Jul. 24, 2013, now U.S. Pat. No. 9,487,742, the disclosures of which are both incorporated by reference in their entirety.

BACKGROUND OF THE INVENTION

1. The Field of the Invention

The present invention relates to drain cleaning formulations, particularly to liquid formulations for use in clearing a partially or fully blocked drain.

2. Description of Related Art

Much art has addressed the problem of developing a thickened cleaning composition, which may contain bleach and may have utility as a hard surface cleanser. The efficacy of such compositions is greatly improved by viscous formulations, increasing the residence time of the cleaner. Splashing during application and use is minimized, and consumer preference for a thick product is well documented. U.S. Pat. No. 4,375,421, issued to Rubin et al. describes a viscous, nonhypochlorite-containing composition containing at least five percent of amido and sulfobetaines, and water-soluble organic or inorganic salts such as sulfates and carbonates. Alkaryl sulfonates are specifically mentioned as possible surfactants for the composition. Rubin et al. is distinguishable, however, in that there is no disclosure of the composition being viscoelastic, and alkyl betaines are specifically excepted from those which are useful. Schilp, U.S. Pat. No. 4,337,163 shows a hypochlorite thickened with an amine oxide or a quaternary ammonium compound, and a saturated fatty acid soap, and mentions that a C8-18 alkyl betaine may be incorporated at levels about equal to the amine oxide (1.5 wt. %). Stoddart, U.S. Pat. No. 4,576,728 shows a thickened hypochlorite including 3- or 4-chlorobenzoic acid, 4-bromobenzic acid, 4-toluic acid and 3-nitrobenzoic acid in combination with an amine oxide, and mentions that a C8-18 alkyl betaine may be incorporated at levels about equal to the amine oxide (1.5 wt. %). Neither Schilp nor Stoddart disclose any thickening or rheological benefits by the optional inclusion of their betaines. DeSimone, U.S. Pat. No. 4,113,645 discloses a method for dispersing a perfume in hypochlorite using a quaternary ammonium compound. Bentham et al, U.S. Pat. No. 4,399,050, discloses hypochlorite thickened with certain carboxylated surfactants, amine oxides and quaternary ammonium compounds. Jeffrey et al, GB 1,466,560 shows bleach with a thickener comprising a sarcosinate or tauride surfactant, and a soap, quaternary ammonium compound, betaine, amine oxide, or alkanolamide. Farkas, U.S. Pat. No. 2,834,737 describes an unthickened hypochlorite bleach having about 0.05-1% of a C10-16 alkyl betaine as a foaming agent and to mask the hypochlorite odor. Hynam, U.S. Pat. No. 3,684,722 describes an alkali-metal hypochlorite which is thickened by a surface active agent, which may be a C8-18 alkyl betaine and a C8-18 soap. Hardy et al., EP 129,980 discloses hypochlorite, an amine oxide or betaine, and an organosilicon quaternary ammonium compound as a bacteriocide, and is limited to an ionic strength of below about 5.0 g moles/dm3. Gray, GB 1,548,379 describes a composition with thickened bleach incorporating a sucrose surfactant with a quaternary ammonium compound, an amine oxide, a betaine, an alkanolimide, or combinations thereof.

For various reasons, the prior art thickened hypochlorite compositions are not commercially viable. In many instances, thickening is insufficient to provide the desired residence time on non-horizontal surfaces. Adding components, and/or modifying characteristics of dissolved components often creates additional problems with the composition, such as syneresis, which require adding further components in an attempt to correct these problems. Polymer thickened hypochlorite bleaching compositions tend to be oxidized by the hypochlorite. Prior art thickened bleach products generally exhibit phase instability at elevated (above about 49 (degree) C.) and/or low (below about 2 (degree) C.) storage temperatures. Difficulties exist with colloidal thickening agents in that these tend to exhibit either false-bodied or thixotropic rheologies, which, at high viscosities, can result in a tendency to set up or harden. Other hypochlorite compositions of the prior art are thickened with surfactants and may exhibit hypochlorite stability problems. Surfactant thickening systems also are not cost effective when used at the levels necessary to obtain desired product viscosity values. European Patent Application 204,472 to Stoddart describes shear-thinning compositions, and seeks to avoid viscoelasticity in such shear-thinning compositions.

Drain cleaners of the art have been formulated with a variety of actives in an effort to remove the variety of materials which can cause clogging or restriction of drains. Such actives may include acids, bases, enzymes, solvents, reducing agents, oxidants and thioorganic compounds. Such compositions are exemplified by U.S. Pat. No. 4,080,305 issued to Holdt et al; U.S. Pat. No. 4,395,344 to Maddox; U.S. Pat. No. 4,587,032 to Rogers; U.S. Pat. No. 4,540,506 issued to Jacobson et al; U.S. Pat. No. 4,610,800 to Durham et al; and European Patent Applications 0,178,931 and 0,185,528, both to Swann et al. Generally, workers in this field have directed their efforts toward actives, or combinations of actives, which would have improved efficacy or speed when used on typically-encountered clog materials; or are safer to use. A problem with this approach, however, is that regardless of the effectiveness of the active, if the composition is not in contact with the clog for a sufficient period of time, the effectiveness of the active will be diminished. This is particularly true for partial clogs where the composition may simply flow by the clog down the drain without having sufficient contact with the clog to dissolve the materials causing the clog. That is why the surfactants, rheological properties and stability of the formulation are just as vital as the actives that help dissolve the clog material (e.g. hair, soap, etc.) because efficacy depends on the composition and the contact time.

Clogging of drains is a recurring and prevalent problem in a wide range of environments. Even with the availability of various drain clearing compositions, there continues to be a need for improved formulations.

BRIEF SUMMARY OF THE INVENTION

In an embodiment, the present invention is directed to a drain cleaning composition comprising 4% to about 12% by weight of a hypochlorite oxidizing agent, 2.5% to about 10% by weight of a hydroxide, 1% to about 15% by weight of a surfactant, and water. In one embodiment, the pH of the composition is advantageously very high, being at least 13.

In another embodiment, the present invention is directed to a drain cleaning composition comprising 4% to about 12% by weight of a hypochlorite oxidizing agent, 2.5% to about 10% by weight of a hydroxide, a charged surfactant, an uncharged surfactant, and water. The composition is monophasic, and the ratio of the charged surfactant to uncharged surfactant is from 1:10 to about 1:50.

In another embodiment, the present invention is directed to a drain cleaning composition consisting essentially of 4% to about 12% by weight sodium hypochlorite, about 0.1% to about 10% by weight sodium hydroxide, a charged surfactant, an uncharged surfactant, and water. The composition is monophasic, and has a pH of at least 13.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which:

FIG. 9 is a table showing compositional and physical property characteristics of various exemplary compositions, including Corrositex™ penetration time for each tested composition.

DETAILED DESCRIPTION OF THE PREFERRED EMBODIMENTS

I. Definitions

Figure 1:
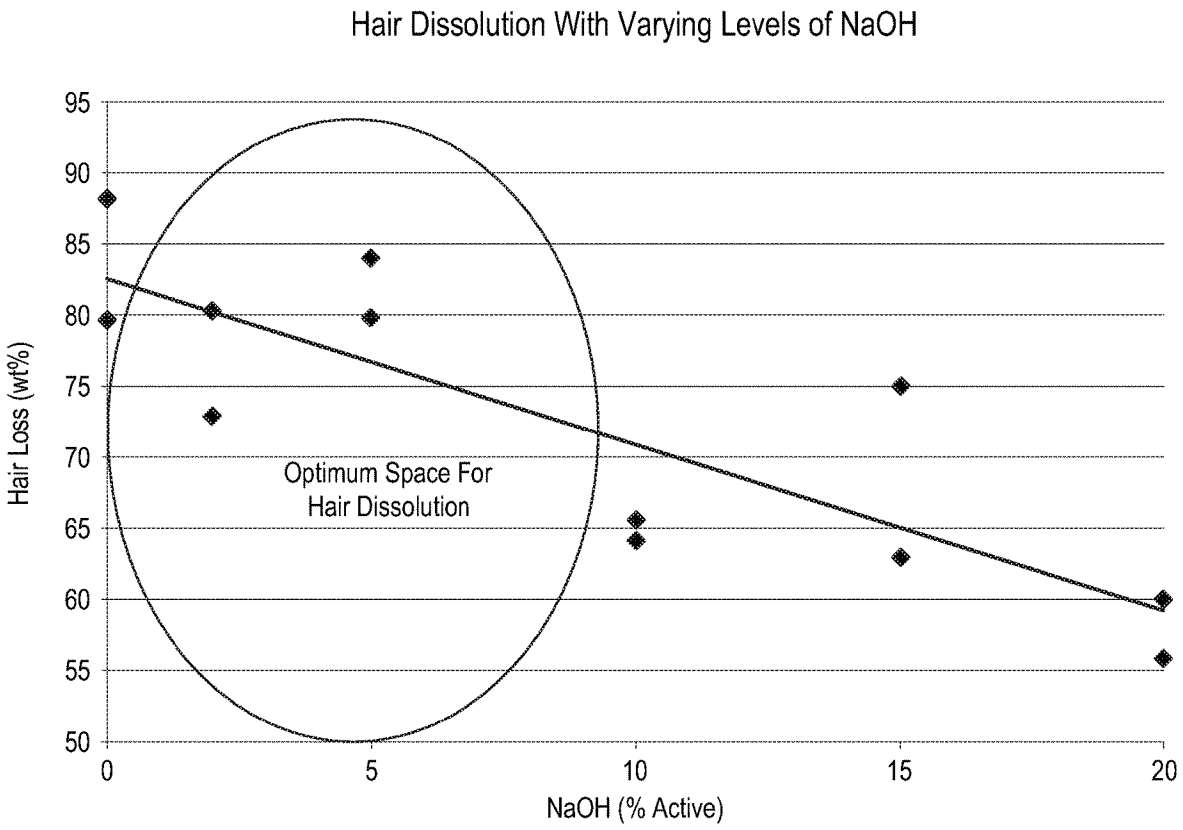
FIG. 1 plots hair dissolution for exemplary compositions with varying levels of sodium hydroxide, where each tested composition includes 5% sodium hypochlorite by weight.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentages ("wt %'s") are in wt % (based on 100 weight % active) of the particular material present in the referenced composition, any remaining percentage typically being water or an aqueous carrier sufficient to account for 100% of the composition, unless otherwise noted. For very low weight percentages, the term "ppm" corresponding to parts per million on a weight/weight basis may be used, noting that 1.0 wt % corresponds to 10,000 ppm.

II. Introduction

Hair is a major component of many drain obstructions, and in one aspect, the present invention is directed to an aqueous drain opening formulation that is particularly effective in hair dissolution so as to quickly unclog drains. The composition preferably has rheology characteristics that provide for easy and aesthetically pleasing dispensing by consumers. In addition, the particularly selected rheology characteristics provide for enhanced residence time of the composition to be in contact with the clog (e.g., particularly in the case of partial clogs where a portion of the drain is open). For example, when clearing a partial clog, there may be a tendency for the composition to be pulled away from the clog under influence of gravity through the open portion of the drain rather than remaining at the site of the clog so as to fully clear the obstruction. The ability of the present compositions to be better retained at the clog site (i.e., increased residence time) results in excellent efficacy.

In one aspect, the drain formulation may have a particular combination, concentration, and ratio of hypohalite and hydroxide ions (sodium hypochlorite and sodium hydroxide, respectively), which have been found by the inventors to provide enhanced hair dissolution properties. For example, it has been demonstrated that hair dissolving drain declogging formulations containing particularly selected levels of sodium hypochlorite and sodium hydroxide are especially effective in hair removal from drains. In particular the inventive drain formulation may be specially designed (e.g., due to its rheological characteristics) to coat and adhere to hair for a longer period of time as compared to existing formulations so as to allow the hypohalite and caustic active components to break down the hair protein and ultimately dissolve the clog.

In an embodiment, the drain formulation preferably includes an effective amount of one or more surfactants which enhances the efficacy of the actives in clog removal. Surprisingly, this can be achieved without increasing the dermal corrosivity characteristics of the drain formulation. To this end, the drain formulation preferably employs a surfactant blend that includes a low ratio of charged to uncharged surfactants to yield thick, monophasic systems having caustic hydroxide concentrations that in an embodiment may be greater than 2% hydroxide (e.g., 2.5 to about 10 weight percent sodium hydroxide). The specifically formulated surfactant blend (e.g., including both charged and uncharged surfactants) has surprisingly been found to result in a monophasic system, even at relatively high hydroxide and/or hypohalite concentrations, at which concentrations the composition would otherwise tend to be biphasic.

For example, the surfactant blend may include both charged and uncharged surfactants, where the ratio of charged surfactant to uncharged surfactant is 1:10 or richer with respect to the uncharged surfactant (e.g., 1:12, 1:15, 1:20, 1:30, etc.). For example, the ratio of charged surfactant to uncharged surfactant may range from 1:10 to about 1:50, or 1:10 to about 1:30. The inventors have found that where the ratio becomes more charged surfactant rich than 1:10 (e.g., a ratio of 1:9), the system may no longer be monophasic, but separates into two phases. It is advantageous to be able to provide a monophasic system, while also providing relatively high hypohalite and relatively high hydroxide concentrations.

In order to provide excellent coating characteristics to a clog during use, the drain formulation preferably has a relatively high zero-shear viscosity. For example, the zero-shear viscosity may be at least 1000 cP, at least about 3000 cP, or from about 3000 cP to about 9000 cP (e.g., all zero shear viscosity values may be at 25° C.). Relaxation times $T_t$ of the composition may be relatively low as compared to other drain clearing formulations, e.g., less than 0.1 s, or less than 0.05 s. Angular relaxation time values (measured in s) may be converted to relaxation time values measured in seconds/cycle (Tau) by multiplying by $2\pi$. $T_t=[Tau/(2\pi)]=/<0.1$ S (preferably, $=/<0.05$ S). $2\pi\ T_t=Tau$, as previously defined in U.S. Pat. No. 5,389,157 to Smith et al., which is herein incorporated by reference in its entirety.

Because of the high caustic hydroxide concentration, the drain formulation may have a pH that is correspondingly higher than typical existing drain clearing formulations. For example, the pH may be at least 13, or greater than 13.

The described rheology characteristics ensure thick and viscous flow behavior at the shear rates associated with flowing down a surface (e.g., along the interior of a vertical pipe) or through an obstruction under force of gravity. Systems with a relatively high relaxation time become elastic more readily under flow and thus are less effective at adhering to surfaces, leading to reduced contact time as compared to the present formulations. The drain formulation's relatively low relaxation time also ensures a smooth appearance as the drain cleaner is poured, which is visually pleasing to consumers. In other words, not only does the composition exhibit thick, viscous characteristics at low shear rates (e.g., exhibiting a critical shear rate of at least 1/sec, or at least 10/sec, or at least 15/sec, or at least 30/sec, etc.), but the appearance and consistency of the composition (e.g., during pouring) is smooth, rather than including undesirable blobs or globs of material that may tend to coalesce together.

The inventive formulations are characterized by a thickening system that is both stable in the presence of hypochlorite bleach and accommodates a relatively high concentration of actives ions. Existing high viscosity, thickened drain cleaners have lower ion concentrations and use bleach stable surfactant blends that would lead to biphasic systems under the high actives load conditions exhibited by the inventive formulations. Surfactant compositions appropriate for thickening the high ion concentrations of the inventive formulations have a low charged to uncharged ratio as described above, such that the ratio of charged surfactant to uncharged surfactant is less than some critical level (e.g., 1:10). The actual critical lower limit of the ratio of charged to uncharged surfactants may depend on various factors, including but not limited to, the presence and concentration of other ions, surfactant chain length, etc. Within the working examples, the inventors have observed that at a ratio of 1 part charged surfactant to 9 parts uncharged surfactant, and with the above described relatively high hydroxide and hypochlorite ion concentrations, the system becomes biphasic. At a ratio that is slightly richer in uncharged surfactant (e.g., 1:10), the system is monophasic.

In an embodiment, the drain cleaning formulation may be opacified to exhibit an enhanced, stable phase appearance. For example, the composition may include an opacifier such as a white latex suspension comprising styrene-acrylate copolymers. The opaque formulation provides gel differentiation versus conventional drain cleaners that are clear.

As described above, it has also been found that the particularly described surfactant blends (e.g., blends of charged and uncharged surfactant) can reduce dermal corrosivity characteristics (e.g., as measured by a Corrositex™ test), while at the same time actually increasing the effectiveness of the composition in clearing a clog. Thus, the compositions can exhibit excellent drain clearing characteristics equal to or better than existing drain cleaners, while also exhibiting dermal corrosivity characteristics (relative to safety considerations for the consumer) that are at least comparable if not better than existing drain cleaners, even while including substantially higher concentrations of hypochlorite and hydroxide within the formulations. In other words, the surfactants provide the added benefit of producing a protective boost or enhancement vis-a-vis the damaging corrosivity characteristics (as measured in terms of the time a substance takes to penetrate a membrane). Ordinarily, compositions with increasing levels of actives such as sodium hydroxide and sodium hypochlorite exhibit higher dermal corrosiveness. While the surfactants enhance the efficacy of the actives in dissolving hair, there is little or no corresponding increase in dermal corrosivity.

III. Exemplary Components of the Aqueous Drain Formulations

A. Oxidizing Agents

The oxidizing agent or oxidant preferably includes a hypohalite (e.g., hypochlorite)—producing species, for example, halogen bleaches selected from the group consisting of the alkali metal and alkaline earth salts of hypohalites. More broadly, a bleach source may be selected from various hypohalite-producing species, for example, halogen bleaches selected from the group consisting of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite may also be suitable. Representative hypochlorite-producing compounds include sodium, potassium, lithium and calcium hypochlorites, chlorinated trisodium phosphate dodecahydrate, potassium and sodium dicholoroisocyanurate and trichlorocyanuric acid. Organic bleach sources suitable for use may include heterocyclic N-bromo and N-chloro imides such as trichlorocyanuric and tribromo-cyanuric acid, dibromo and dichlorocyanuric acid, and potassium and sodium salts thereof, N-brominated and N-chlorinated succinimide, malonimide, phthalimide and naphthalimide. Hydantoins, such as dibromo and dichloro dimethyl-hydantoin, chlorobromodimethyl hydantoin, N-chlorosulfamide (haloamide) and chloramine (haloamine) may also be suitable. Combinations of such components may also be employed.

A particularly preferred hypochlorite-producing compound is sodium hypochlorite. The hypohalite (e.g., sodium hypochlorite) may be present in an amount ranging from about 0.1 to about 15 weight percent, about 4 weight percent to about 12 weight percent, or from about 5 weight percent to about 7 weight percent of the aqueous drain formulation.

B. Hydroxide Stabilizing Agents

A caustic bleach stable hydroxide is included. The hydroxide serves to provide a very high pH, acts to help in break up of the clog (e.g., hair dissolution), and substantially enhances the stability of the hypohalite (e.g., hypochlorite) producing oxidant. Exemplary stabilizers include alkali metals of hydroxide, such as sodium, lithium, potassium hydroxide, or combinations thereof. Sodium hydroxide is a particularly preferred example. The hydroxide may comprise from 0.1 to 15, 0.1 to 10, from 2.5 to 10, or from 7 to 8 percent of the aqueous drain formulation by weight. The aqueous drain formulation preferably has a pH of at least 13, or above 13, providing both hair dissolution efficacy and hypochlorite stability. The particularly preferred ranges of sodium hypochlorite (e.g., 4 to 12 weight percent, more particularly 5 to 7 weight percent) and sodium hydroxide (e.g., 2.5 to 10 weight percent, more particularly 7 to 8 weight percent) have been found by the inventors to provide enhanced hair dissolution as compared to lower weight fractions employed previously.

C. Surfactants

Surfactants aid in providing thickening, providing other desired rheological characteristics, and in providing improved phase stability (e.g., the ability to maintain a monophasic system, even with high hydroxide and hypohalite ion loading). Surfactants may be oxidant stable anionic surfactants, nonionic surfactants, zwitterionic surfactants, amphoteric surfactants, cationic surfactants, ampholytic surfactants, or mixtures thereof. Preferably, a surfactant blend having a low ratio of charged to uncharged surfactants is used. The total amount of surfactant typically ranges from 1 to 15, and preferably from 3 to 10 weight percent of the aqueous drain formulation. Preferred uncharged surfactants include amine oxide surfactants, e.g., alkyl amine oxide surfactants such as lauryl dimethylamine oxide and myristamine oxide. Such alkyl amine oxide surfactants may include chain lengths from 6 to 18 carbons (e.g., lauryl designates a $C_{12}$ chain, myristyl designates a $C_{14}$ chain).

A preferred charged surfactant is a fatty acid (e.g., coconut fatty acid), which is nonionic at neutral pH, but becomes charged (e.g., anionic) under the high pH conditions associated with the composition. Coconut fatty acid may refer to a mixture of alkyl fatty acids having carbon chain lengths from 6 to 18, with the vast majority of the components being $C_{12}$ and $C_{14}$. Other suitable charged surfactants include but are not limited to sodium lauryl sulfate (SLS), linear alkyl benzene sulfonate (LABS) and any other suitable sulfate or sulfonate surfactants and any combinations or mixtures thereof. Surfactant blends with particularly preferred low ratios of charged to uncharged surfactants yield thick, monophasic systems with relatively high caustic hydroxide levels (greater than about 2% NaOH). Preferred surfactant ratios also have been shown to reduce dermal corrosivity characteristics (as measured by the time a substance takes to penetrate the test membrane).

Other nonionic, anionic, cationic, ampholytic, amphoteric and zwitterionic surfactants and mixtures thereof may be suitable for use. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Each of the above patents is incorporated by reference in its entirety.

D. Opacifier

The drain formulation may be opaque, through inclusion of an opacifier. A preferred opacifier is white latex suspension which imparts an enhanced, stable phase appearance to the formulation. These visual characteristics, together with the thick, viscous, but smooth flow characteristics (e.g., the absence of the formation of coalescent blobs or globs), provide an aesthetically desirable delivery and flow appearance. The opacifier is preferably stable at the above described elevated hypochlorite and hydroxide concentrations. Suitable white latex suspensions are composed of styrene-acrylate copolymers. The opacifier typically comprises from 0.05% to 1.0% by weight of the aqueous drain formulation. Other opacifiers may also be suitable for use.

E. Additional Adjuvants

The drain formulation can comprise coloring agents including dyes and pigments. Fragrances (e.g., bleach stable) and corrosion inhibitors can also be employed. Alkali metal silicates (e.g., sodium silicate) are a preferred class of corrosion inhibitors for minimizing corrosion within steel pipes.

F. Water

The balance of the aqueous drain formulation may comprise water. For example, the water content may typically range from 50 to 90 percent of the formulation by weight. Soft or distilled water is preferred to minimize effects of trace ions, resulting in a stable, viscous, optionally opacified drain clearing formulation.

In use, the aqueous drain formulation may be dispensed from a bottle container into a fully or partially clogged drain. The formulation is allowed to react with the clogging material, often including hair, for 30 minutes or longer. Typically, about 75 to 250 mL of the drain formulation may be used. Thereafter, the drain may be flushed with water to remove any remaining drain formulation and clog remnants. The process can be repeated as necessary.

IV. Exemplary Formulations and Test Results

Table 1 sets forth exemplary preferred ranges for components of several drain cleaning formulations that were prepared according to the working examples of the present invention.

TABLE 1

| Example 1 | | | | |
|---|---|---|---|---|
| Component | Function | Trade Name | Wt % Active | CAS # |
| Water | Diluent | | Balance | |
| Caustic Soda (50%) NaOH | Raises pH, stabilizes bleach, hair clog dissolution | | 2.5-10% | 1310-73-2 |
| Lauryl Dimethylamine Oxide (31%) | Thickener, nonionic surfactant | Ammonyx LO | 0-5.0% | 1643-20-5 |
| Myristamine Oxide | Thickener, nonionic surfactant | Ammonyx MO | 0.5-10.0% | 3332-27-2 |
| Coconut Fatty Acid | Thickener, anionic surfactant | | 0.1-2.0% | 68937-85-9; 90990-15-1; 101403-98-9 |
| Sodium Hypochlorite | Oxidizer, hair clog dissolution | Bleach | 4.0-12.0% | 7681-52-9 |
| Sodium Silicate | Corrosion inhibitor | | 0.10-2.0% | 1344-09-8 |
| Latex Opacifier (38%) | Opacifier | Alcoguard 7100 | 0.10-1.0% | |

The zero-shear viscosities of several exemplary drain formulations were measured and the data is set forth in Tables 2-6.

TABLE 2

| Example 2 | |
|---|---|
| Component name | Wt % Actives in Formula |
| Sodium Hypochlorite | 6.00% |
| Sodium Hydroxide | 8.00% |
| Sodium Silicate | 0.80% |
| Coconut fatty acid | 0.25% |
| Ammonyx LO | 0.48% |
| Ammonyx MO | 4.28% |
| Alcoguard 7100 | 0.20% |
| Water | Balance |
| Charged/Uncharged Ratio | 1:19 |
| ZSV (zero shear viscosity) @ 25° C. (cP) | 5687 |
| pH | ~13 |

TABLE 3

| Example 3 | |
|---|---|
| Component name | Wt % Actives in Formula |
| Sodium Hypochlorite | 5.00% |
| Sodium Hydroxide | 8.00% |
| Sodium Silicate | 0.80% |
| Coconut fatty acid | 0.24% |
| Ammonyx LO | 0.00% |
| Ammonyx MO | 4.51% |
| Alcoguard 7100 | 0.20% |
| Water | Balance |
| Charged/Uncharged Ratio | 1:19 |
| ZSV (zero shear viscosity) @ 25° C. (cP) | 5008 |
| pH | ~13 |

TABLE 4

| Example 4 | |
|---|---|
| Component name | Wt % Actives in Formula |
| Sodium Hypochlorite | 5.00% |
| Sodium Hydroxide | 8.00% |
| Sodium Silicate | 0.80% |
| Coconut fatty acid | 0.25% |
| Ammonyx LO | 0.00% |
| Ammonyx MO | 4.75% |
| Alcoguard 7100 | 0.20% |
| Water | Balance |
| Charged/Uncharged Ratio | 1:19 |
| ZSV (zero shear viscosity) @ 25° C. (cP) | 5094 |
| pH | ~13 |

TABLE 5

| Example 5 | |
|---|---|
| Component name | Wt % Actives in Formula |
| Sodium Hypochlorite | 6.00% |
| Sodium Hydroxide | 8.00% |
| Sodium Silicate | 0.80% |
| Coconut fatty acid | 0.23% |
| Ammonyx LO | 0.43% |
| Ammonyx MO | 3.85% |
| Alcoguard 7100 | 0.20% |
| Water | Balance |
| Charged/Uncharged Ratio | 1:19 |
| ZSV (zero shear viscosity) @ 25° C. (cP) | 5185 |
| pH | ~13 |

TABLE 6

| Example 6 | |
|---|---|
| Component name | Wt % Actives in Formula |
| Sodium Hypochlorite | 5.00% |
| Sodium Hydroxide | 8.00% |
| Sodium Silicate | 0.80% |

TABLE 6-continued

| Example 6 | |
|---|---|
| Component name | Wt % Actives in Formula |
| Coconut fatty acid | 0.20% |
| Ammonyx LO | 0.76% |
| Ammonyx MO | 3.04% |
| Alcoguard 7100 | 0.20% |
| Water | Balance |
| Charged/Uncharged Ratio | 1:19 |
| ZSV (zero shear viscosity) @ 25° C. (cP) | 3516 |
| pH | ~13 |

A. Selected Levels of Sodium Hypochlorite and Sodium Hydroxide

Correlated to Enhanced Hair Dissolution

Figure 2:
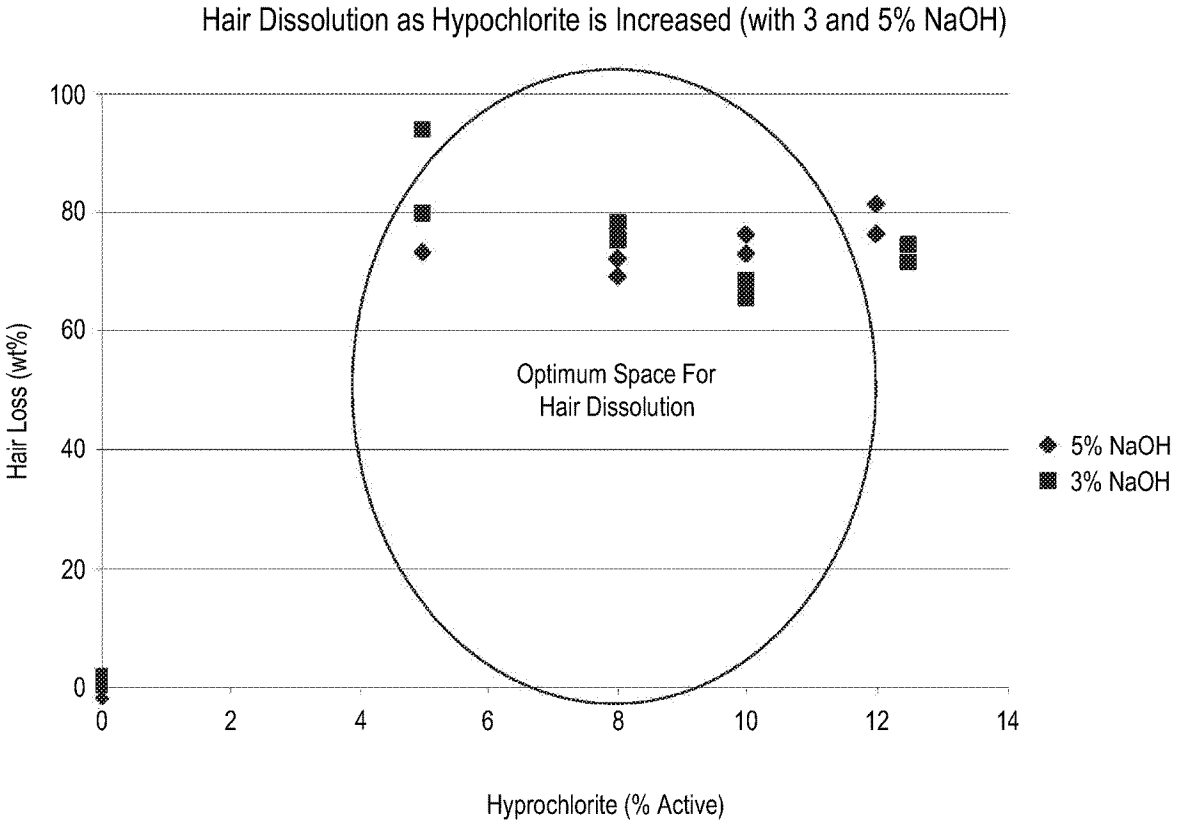
FIG. 2 plots hair dissolution for various exemplary compositions with varying levels of sodium hypochlorite, where one set of tested compositions includes 3% sodium hydroxide by weight, and another set of tested compositions includes 5% sodium hydroxide by weight.

Formulations containing 0-20% NaOH and 0-14% NaOCl were tested for their ability to dissolve hair (i.e., weight percent hair loss). FIG. 1 plots hair dissolution percentages with varying levels of NaOH, with 5% NaOCl. The results demonstrate that hair dissolution was highest when the NaOH was below about 10% and that 5% hypochlorite alone actually showed good hair dissolution. FIG. 2 shows hair dissolution characteristics for compositions including 3% NaOH or 5% NaOH, with varying levels of hypochlorite. The data demonstrate that hair dissolution is more or less equal (e.g., about 70% to about 90% hair weight loss) from about 4% to about 12% NaOCl, and demonstrates that NaOH alone did not breakdown hair, which is surprising. Hair dissolution is highest with about 4% or more NaOCl.

Highly Viscous Formulations for Enhanced Active Delivery System in Drain (with >2% NaOH)

In Example 7A, a formulation with 15% NaOH, 5% NaOCl, and a surfactant blend including 0.6% coconut fatty acid (CFA) and 5.4% Lauryl Dimethylamine Oxide (LO) formed a biphasic system in the presence of the high hydroxide and hypochlorite ion concentrations. The ratio of charged surfactant (i.e., the CFA) to uncharged surfactant (i.e., the LO) in Example 7A was 1:9. A similar formulation (Example 7B) containing 0.3% CFA and 5.7% LO was made monophasic due to the decrease in the ratio of charged surfactant to uncharged surfactant. The ratio of charged surfactant (i.e., the CFA) to uncharged surfactant (i.e., the LO) in Example 7B was 1:19. The balance of each formulation was water.

TABLE 7

| | Example 7A (biphasic) | Example 7B (monophasic) |
|---|---|---|
| NaOH | 15% | 15% |
| NaOCl | 5% | 5% |
| CFA | 0.6% | 0.3% |
| LO | 5.4% | 5.7% |
| CFA:LO | 1:9 | 1:19 |

A similar transition from biphasic to monophasic with decreasing ionic ratio is observed with other anionic surfactants, as shown in Table 8 for SLS, and in Table 9 for LABS.

TABLE 8

| | Example 8A (biphasic) | Example 8B (monophasic) | Example 8C (monophasic) |
|---|---|---|---|
| NaOH | 8% | 8% | 8% |
| NaOCl (equimolar) | 5% | 5% | 5% |
| SLS | 0.40% | 0.20% | 0.10% |
| MO | 3.60% | 3.80% | 3.90% |
| Water | Balance | Balance | Balance |
| SLS:MO | 1:9 | 1:19 | 1:39 |
| Viscosity at 10/s | N/A (biphasic) | 2780 cP | 3510 cP |
| ZSV at 25° C. | N/A (biphasic) | 3050 cP | 4000 cP |
| Critical Shear Rate | N/A (biphasic) | 15/s | 10/s |

TABLE 9

| | Example 9A (biphasic) | Example 9B (monophasic) | Example 9C (monophasic) |
|---|---|---|---|
| NaOH | 8% | 8% | 8% |
| NaOCl (equimolar) | 5% | 5% | 5% |
| LABS | 0.40% | 0.20% | 0.10% |
| MO | 3.60% | 3.80% | 3.90% |
| Water | Balance | Balance | Balance |
| LABS:MO | 1:9 | 1:19 | 1:39 |
| Viscosity at 10/s | N/A (biphasic) | 1280 cP | 2360 cP |
| ZSV at 25° C. | N/A (biphasic) | 1340 cP | 2580 cP |
| Critical Shear Rate | N/A (biphasic) | 30/s | 15/s |

Further adjustments to achieve the desired viscosity can be made by changing chain length of one or more of the surfactants, or adjusting the total surfactant concentration. Table 10 illustrates inventive compositions with zero-shear viscosities in preferred ranges of at least 1000 cP, or from about 3000 cP to 9000 cP. The examples of Table 10 include myristamine oxide, also known as myristyl dimethylamine oxide (MO) as the uncharged surfactant.

TABLE 10

| | Example 10A (monophasic) | Example 10B (monophasic) | Example 10C (monophasic) |
|---|---|---|---|
| NaOH | 8% | 8% | 8% |
| NaOCl | 5% | 5% | 5% |
| CFA | 0.15% | 0.2% | 0.225% |
| MO | 2.85% | 3.8% | 4.28% |
| CFA:MO | 1:19 | 1:19 | 1:19 |
| ZSV at 25° C. | 2600 | 3950 | 4150 |

Figure 3:
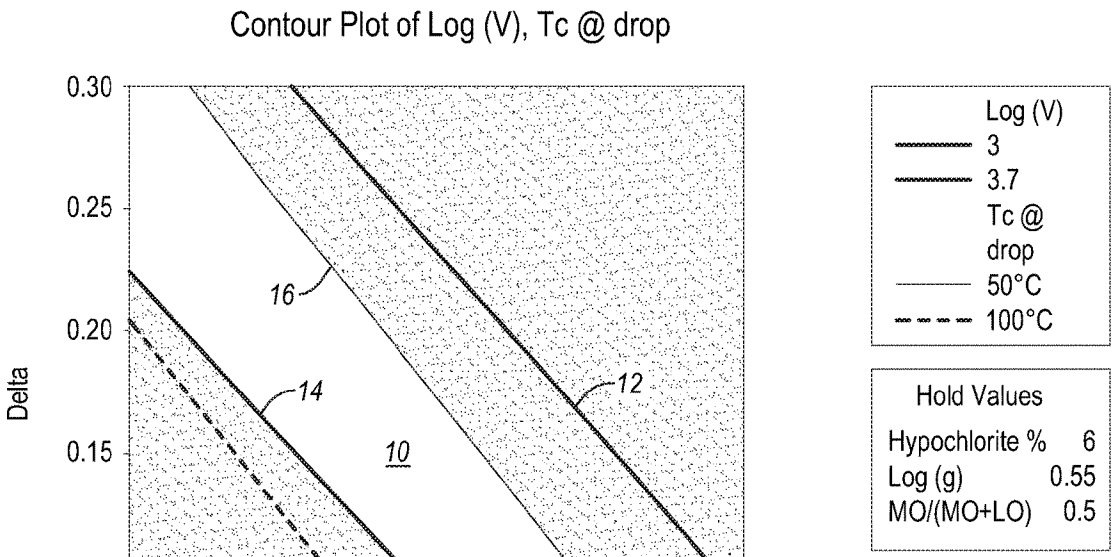
FIG. 3 is a contour plot generated from measurement of zero-shear viscosities and flocculation temperatures (the temperature at which systems become biphasic) of a large set of exemplary compositions while varying concentrations of one or more of sodium hypochlorite, sodium hydroxide, coconut fatty acid charged surfactant, and amphoteric amine oxide uncharged surfactants.

In general, the higher the caustic concentration, the lower the proportion of charged surfactant required in order for the drain formulation to remain monophasic. In Tables 7-9 above, the phase behavior of these exemplary formulations shows that at a 1:9 ratio of charged:uncharged surfactant the compositions are cloudy and biphasic at 25° C. In Tables 7-9 above, the phase behavior of these exemplary formulations shows that at 1:19 (and 1:39 for Tables 8-9) ratios of charged: uncharged surfactant the compositions are clear and monophasic at 25° C. The similar phase behavior results are shown in FIG. 3. FIG. 3 is a contour plot generated from measurements of zero-shear viscosity and flocculation temperature (Tc, the temperature above which a system becomes biphasic) of a large set of formulations while varying concentration of one or more of bleach, caustic, CFA, Ammonyx LO, or Ammonyx MO.

For the contour plot of FIG. 3, three of these five compositional variables were fixed (6% hypo, 3.55% total surfactant, and the proportion of MO to total uncharged surfactant=0.5 (i.e., MO/(MO+LO))), leaving 2 compositional variables to be plotted (% caustic, and delta, where delta=proportion of surfactant that is CFA (i.e., CFA/(CFA+MO+LO)). The white area 10 represents all compositions that would meet the criteria of zero-shear viscosity greater than 1000 cP (between line 12 and line 14 where log(V)=3) and have a flocculation temperature above 50° C. (below line 16). Line 18 represents a flocculation temperature of 100° C.

The contour plot illustrates that in order to stay monophasic (i.e. below the line 16), increasing levels of caustic have to be compensated for by decreasing delta, the proportion of charged surfactant (e.g., CFA, SLS, LABS, etc.). For example, CFA is nonionic at neutral pH, but becomes anionic at the high pH values associated with the present compositions. Delta is the proportion of charged surfactant (e.g., anionic or cationic surfactants with charged head groups at formulation conditions). Preferred ranges for delta (e.g., corresponding to proportion of surfactant that is charged) are from 0.01 to 0.1 0.05 to 0.099, 0.02 to 0.09, 0.03 to 0.08, or 0.01 to 0.07

Figure 4:
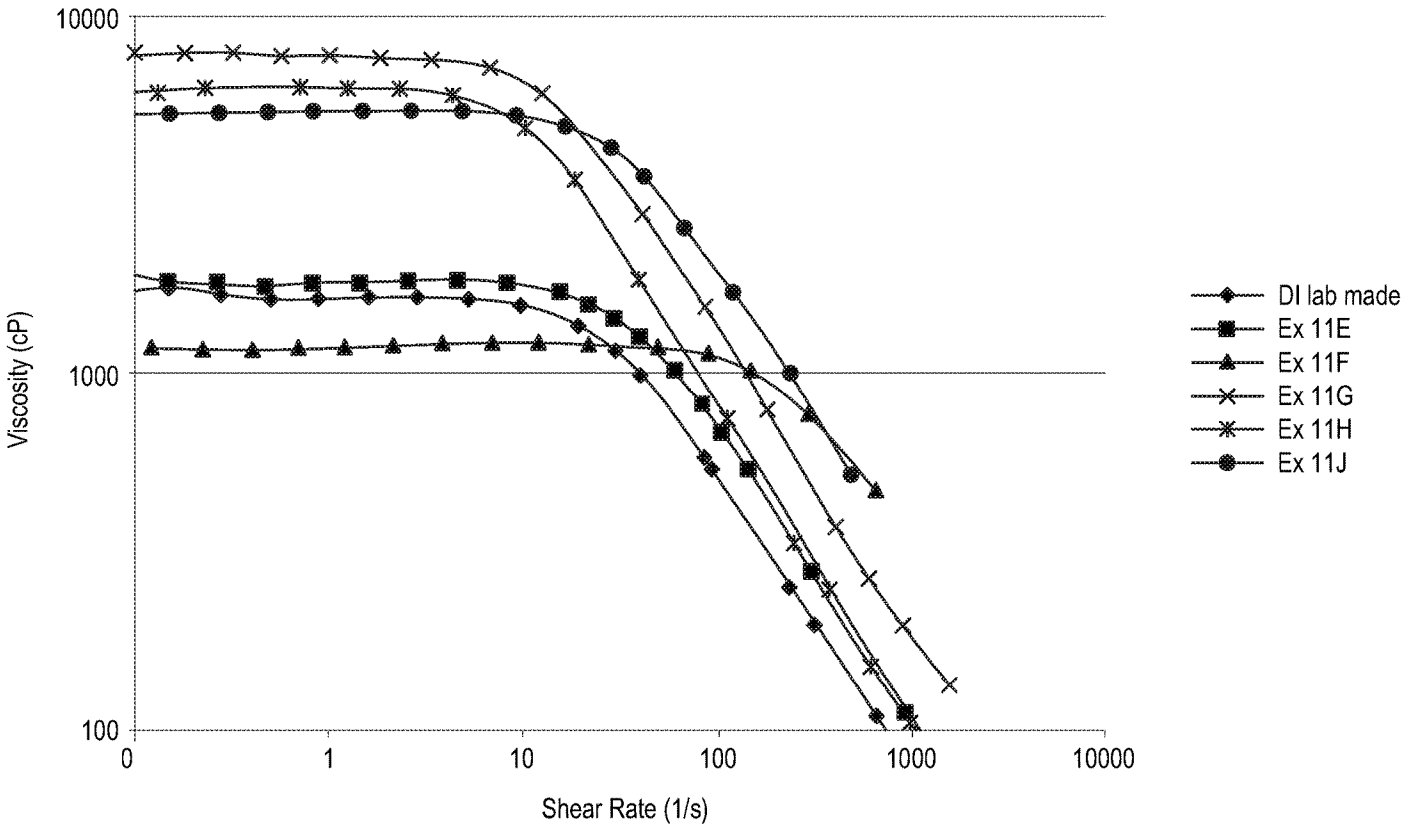
FIG. 4 plots the viscosity versus shear rate for several exemplary compositions. DI lab made formula is the Liquid-Plumr® Double Impact® formula.
Figure 5:
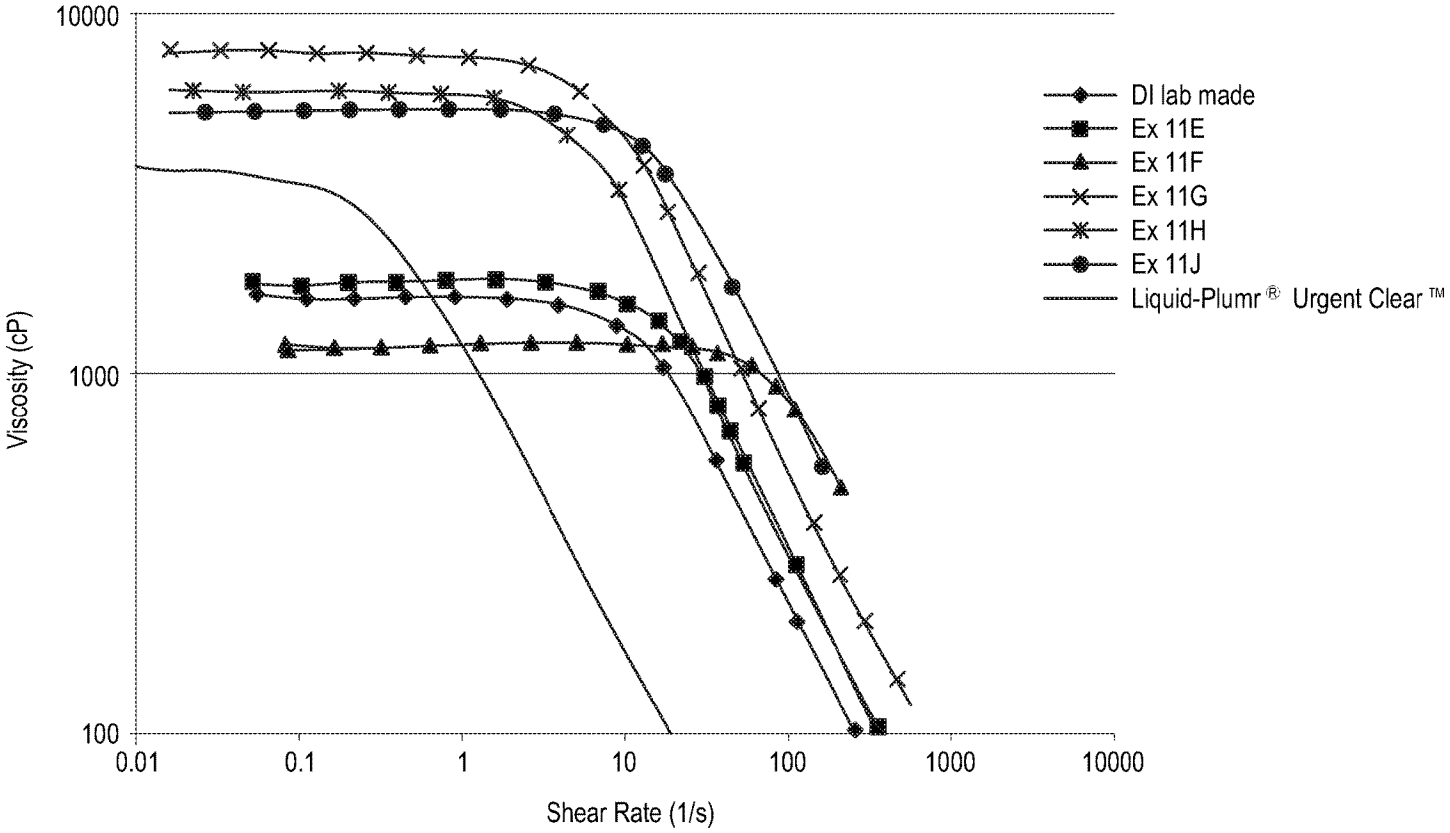
FIG. 5 plots the viscosity versus shear rate data as presented in FIG. 4, as compared to the formula from the viscoelastic side of Liquid-Plumr® Urgent Clear™.

The inventive formulations have a high zero-shear viscosity and relatively high critical shear rate. The viscosity vs. shear rate of 7 different drain cleaning formulations were measured and the results are shown in FIGS. 4-5. The components and their weight fractions of the tested formulations are set forth Table 11, below. The balance of the compositions was water.

TABLE 11

| Component | Ex 11A | Ex 11B | Ex 11C | Ex 11D | Ex 11E | Ex 11F | Ex 11G | Ex 11H | Ex 1I | Ex 11J |
|---|---|---|---|---|---|---|---|---|---|---|
| LO | | | 0.64 | 0 | 0 | 5.7 | 0.88 | 0 | 0 | 1.62 |
| MO | | | 1.91 | 2.55 | 2.7 | 0 | 3.54 | 3.49 | 3.49 | 3.78 |
| CFA | | | 0.45 | 0.45 | 0.3 | 0.3 | 0.78 | 0.615 | 0.615 | 0.6 |
| CFA:AO | | | 1:5.7 | 1:5.7 | 1:9 | 1:19 | 1:5.7 | 1:5.7 | 1:5.7 | 1:9 |
| NaOH | 18.85 | 3.2 | 3.6 | 3 | 8 | 11 | 3.6 | 3 | 2.68 | 7 |
| NaOCl | 7.95 | 12 | 7.95 | 5 | 4.56 | 5 | 7.95 | 5 | 8.19 | 7 |
| ZSV @ 25° C. | | | 2900 | 3600 | 1780 | 1160 | 7550 | 5990 | 7400 | 5170 |
| Tc (° C.) | | | 60 | 66 | 38 | 61 | 64 | 70 | 59 | 58 |

Thickening systems commonly used for this type of active (e.g., bleach) are oxidant stable surfactants that form a network of entangled micelles, giving a viscoelastic rheology. Such systems are characterized by a region of constant viscosity at low shear rates, called the zero shear viscosity, and a critical shear rate, which is the shear rate at which the elongated micelles begin to align and flow more easily in shear flow, leading to a decrease in viscosity, as readily seen in FIGS. 4-5. The inventive formulations have a high zero-shear viscosity and a relatively high critical shear rate. This type of rheology provides thick and viscous flow behavior at the shear rates associated with flowing down a surface or through an obstruction under influence of gravity. Systems with a small critical shear rate become elastic more readily under flow and thus less effective at adhering to surfaces, leading to reduced contact time (undesirable).

Preferred values of zero-shear viscosity are 1000 cP or higher, with a critical shear rate of at least 1/sec. (e.g., at least about 5/sec, or at least about 10/sec). FIG. 5 shows similar data as presented in FIG. 4, as compared to the formula from the viscoelastic side of Liquid-Plumr® Urgent Clear™. The formula from the viscoelastic side of Liquid-Plumr® Urgent Clear™ curve in FIG. 5 has a zero-shear viscosity of about 3500 cP, but exhibits a low critical shear rate (e.g., about 0.2/sec.), and as a result will exhibit greater elasticity and will stick less well to the clog. Indeed, this portion of the Liquid-Plumr® Urgent Clear™ formulation was not designed to cling to surfaces, but to deliver more of the active to a full clog through standing water. At the greater critical shear viscosity associated with the present compositions, clog removal performance will improve with increasing zero-shear viscosity.

Figure 6:
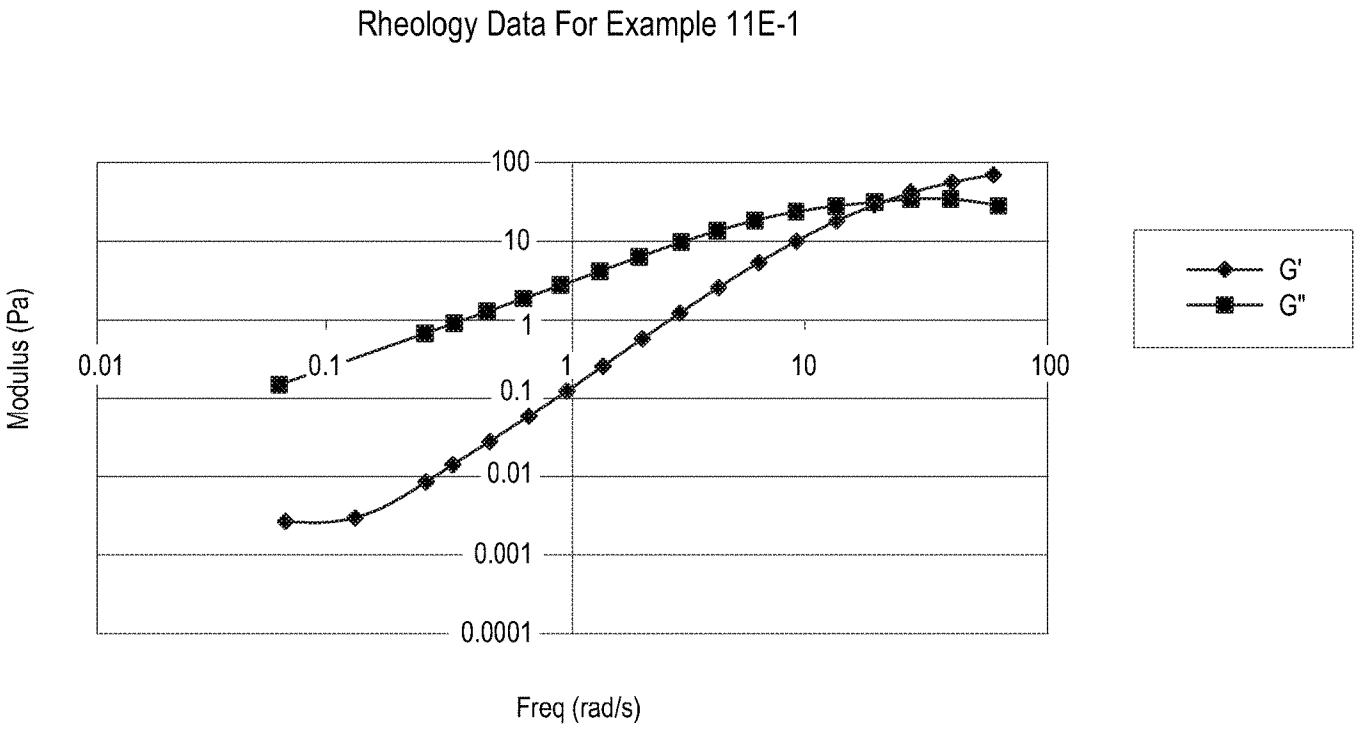
FIG. 6 plots the elastic modulus (G') and viscous modulus (G") versus frequency for Example 11E-1.
Figure 7:
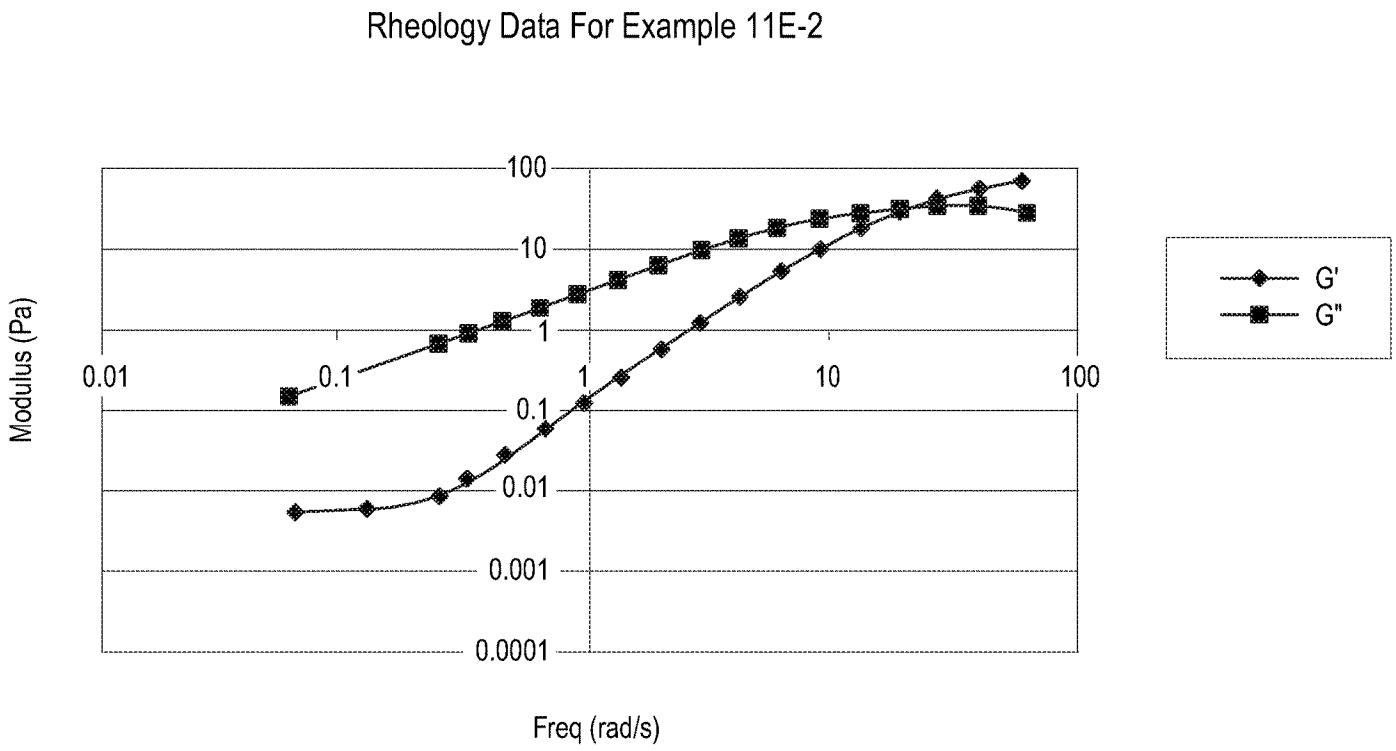
FIG. 7 plots the elastic modulus (G') and viscous modulus (G") versus frequency for Example 11E-2.
Figure 8:
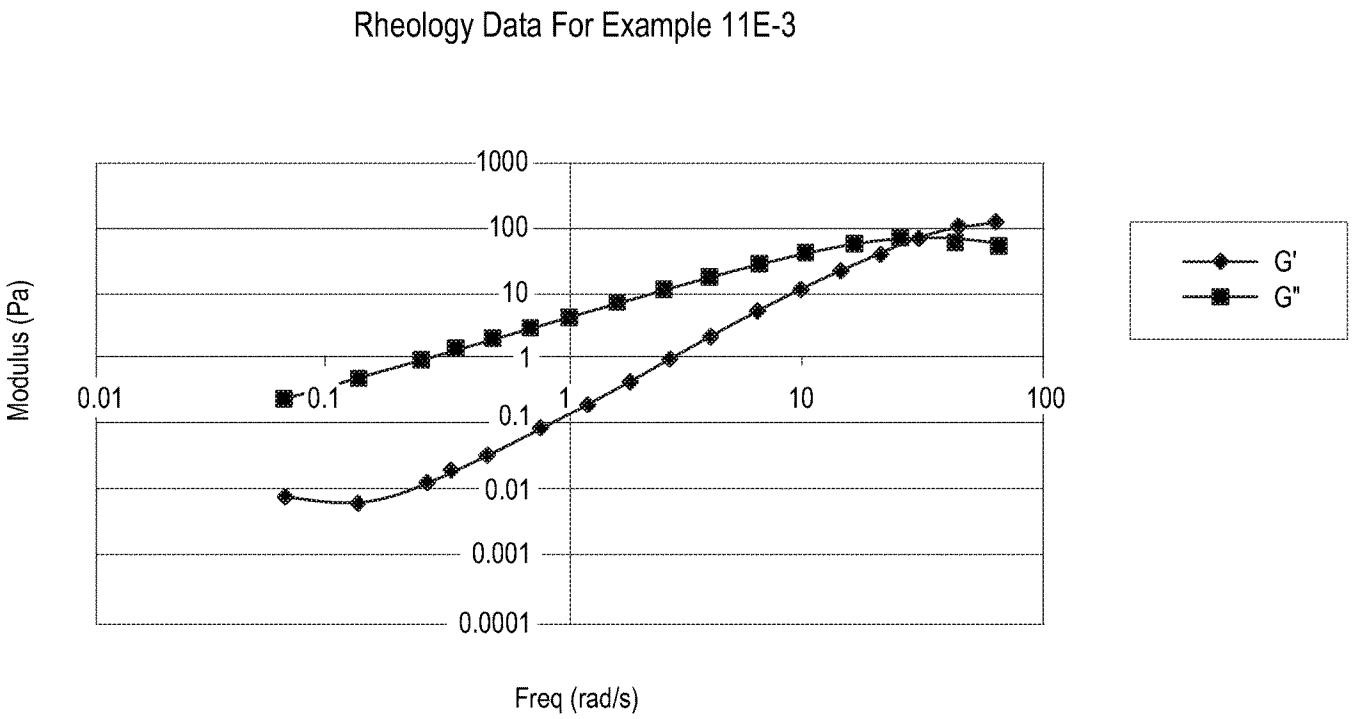
FIG. 8 plots the elastic modulus (G') and viscous modulus (G") versus frequency for Example 11E-3.

The rheology of the drain cleaning composition was also measured with a Stresstech rheometer at 25° C. in the oscillatory mode and in the viscometry mode, using concentric cylinder geometry. A frequency sweep with a Stresstech rheometer produced oscillation data which shows the elastic and viscous moduli, G' and G" respectively, and the (complex) Viscosity, as a function of frequency. FIGS. 6-8 and accompanying Tables 12-14 show the results for three formulations (Formulations 11E-1 through 11E-3), each based on Example 11E. Values for $T_r$, $G_o$, and $\eta°$ for the testing shown in Table 12 were 0.043383 s, 59.00218 Pa, and 2547.018 cP, respectively.

TABLE 12

| Time (sec) | Temp (° C.) | Freq. (Hz) | Stress (Pa) | Strain | Phase (°) | G* (Pa) | G' (Pa) | G" (Pa) | Viscosity (Pa-s) | Torque (Nm) |
|---|---|---|---|---|---|---|---|---|---|---|
| 5.1 | 25.1 | 1.00E−02 | 4.16E−01 | 2.60E+00 | 89.1 | 1.60E−01 | 2.59E−03 | 1.60E−01 | 2.55E+00 | 1.66E−05 |
| 209.9 | 25.1 | 2.00E−02 | 5.47E+01 | 1.73E+00 | 89.5 | 3.17E−01 | 2.66E−03 | 3.17E−01 | 2.52E+00 | 2.19E−05 |
| 314.5 | 25 | 4.00E−02 | 7.33E−01 | 1.13E+00 | 89.3 | 6.48E−01 | 7.41E−03 | 6.48E−01 | 2.58E+00 | 2.93E−05 |
| 368.5 | 25 | 4.00E−02 | 8.07E−01 | 1.00E+00 | 89.1 | 8.07E−01 | 1.29E−02 | 8.07E−01 | 2.57E+00 | 3.23E−05 |
| 413.3 | 24.9 | 7.30E−02 | 9.54E−01 | 8.15E−01 | 88.7 | 1.17E+00 | 2.63E−02 | 1.17E+00 | 2.55E+00 | 3.82E−05 |
| 444.3 | 25 | 1.07E−01 | 1.13E+00 | 6.61E−01 | 88.2 | 1.71E+00 | 5.31E−02 | 1.71E+00 | 2.55E+00 | 4.52E−05 |
| 467.1 | 25.1 | 1.56E−01 | 1.35E+00 | 5.42E−01 | 87.5 | 2.49E+00 | 1.10E−01 | 2.48E+00 | 2.54E+00 | 5.38E−05 |
| 485.4 | 25 | 2.28E−01 | 1.61E+00 | 4.43E−01 | 86.4 | 3.63E+00 | 2.29E−01 | 3.63E+00 | 2.54E+00 | 6.42E−05 |
| 501.3 | 25 | 3.32E−01 | 1.92E+00 | 3.65E−01 | 84.8 | 5.28E+00 | 4.76E−01 | 5.26E+00 | 2.53E+00 | 7.68E−05 |
| 515.8 | 25 | 4.85E−01 | 2.30E+00 | 3.05E−01 | 82.6 | 7.60E+00 | 9.74E−01 | 7.53E+00 | 2.49E+00 | 9.20E−05 |
| 529.4 | 25 | 7.08E−01 | 2.76E+00 | 2.58E−01 | 79.4 | 1.09E+01 | 2.00E+00 | 1.07E+01 | 2.44E+00 | 1.10E−04 |
| 542.1 | 25.1 | 1.03E+00 | 3.31E+00 | 2.20E−01 | 74.8 | 1.55E+01 | 4.08E+00 | 1.50E+01 | 2.40E+00 | 1.32E−04 |

TABLE 12-continued

| Time (sec) | Temp (° C.) | Freq. (Hz) | Stress (Pa) | Strain | Phase (°) | G* (Pa) | G' (Pa) | G'' (Pa) | Viscosity (Pa-s) | Torque (Nm) |
|---|---|---|---|---|---|---|---|---|---|---|
| 555.7 | 25.1 | 1.51E+00 | 3.98E+00 | 1.94E−01 | 68.6 | 2.19E+01 | 8.02E+00 | 2.04E+01 | 2.32E+00 | 1.59E−04 |
| 569.1 | 25 | 2.20E+00 | 4.79E+00 | 1.81E−01 | 60.3 | 3.03E+01 | 1.50E+01 | 2.63E+01 | 2.19E+00 | 1.92E−04 |
| 583 | 25 | 3.21E+00 | 5.77E+00 | 1.88E−01 | 50.7 | 3.96E+01 | 2.50E+01 | 3.06E+01 | 1.96E+00 | 2.31E−04 |
| 596.3 | 25 | 4.69E+00 | 6.95E+00 | 1.94E−01 | 39.9 | 4.86E+01 | 3.73E+03 | 3.12E+01 | 1.65E+00 | 2.78E−04 |
| 609.2 | 24.8 | 6.85E+00 | 8.38E+00 | 1.13E−01 | 30.2 | 5.61E+01 | 4.85E+01 | 2.83E+01 | 1.30E+00 | 3.35E−04 |
| 621.7 | 25 | 1.00E+01 | 1.01E+01 | 5.26E−02 | 21.7 | 6.27E+01 | 5.83E+01 | 2.32E+01 | 9.98E−01 | 4.04E−04 |

TABLE 13

| Time (sec) | Temp (° C.) | Freq. (Hz) | Stress (Pa) | Strain | Phase (°) | G* (Pa) | G' (Pa) | G'' (Pa) | Viscosity (Pa-s) | Torque (Nm) |
|---|---|---|---|---|---|---|---|---|---|---|
| 5.1 | 25 | 1.00E−02 | 4.16E−01 | 1.73E+00 | 88.6 | 2.40E−01 | 5.70E−03 | 2.40E−01 | 3.82E+00 | 1.66E−05 |
| 210.6 | 25 | 2.00E−02 | 5.47E−01 | 1.14E+00 | 89.2 | 4.80E−01 | 6.50E−03 | 4.80E−01 | 3.82E+00 | 2.19E−05 |
| 315.1 | 25.1 | 4.00E−02 | 7.33E−01 | 7.62E−01 | 89.4 | 9.61E−01 | 9.84E−03 | 9.61E−01 | 3.82E+00 | 2.93E−05 |
| 369.5 | 24.9 | 5.00E−02 | 8.07E−01 | 6.64E−01 | 89.1 | 1.22E+00 | 1.82E−02 | 1.22E+00 | 3.87E+00 | 3.23E−05 |
| 414.1 | 25 | 7.30E−02 | 9.54E−01 | 5.40E−01 | 88.7 | 1.77E+00 | 3.87E−02 | 1.77E+00 | 3.85E+00 | 3.82E−05 |
| 445.1 | 24.9 | 1.07E−01 | 1.13E+00 | 4.40E−01 | 88.2 | 2.57E+00 | 8.00E−02 | 2.57E+00 | 3.82E+00 | 4.52E−05 |
| 467.8 | 24.9 | 1.56E−01 | 1.35E+00 | 3.61E−01 | 87.4 | 3.73E+00 | 1.69E−01 | 3.73E+00 | 3.81E+00 | 5.38E−05 |
| 486.2 | 25.1 | 2.28E−01 | 1.61E+00 | 2.99E−01 | 86.4 | 5.39E+00 | 3.41E−01 | 5.38E+00 | 3.76E+00 | 6.42E−05 |
| 502.2 | 25 | 3.32E−01 | 1.92E+00 | 2.45E−01 | 85 | 7.87E+00 | 6.89E−01 | 7.84E+00 | 3.77E+00 | 7.68E−05 |
| 516.6 | 25 | 4.85E−01 | 2.30E+00 | 2.04E−01 | 83.1 | 1.13E+01 | 1.36E+00 | 1.12E+01 | 3.71E+00 | 9.20E−05 |
| 530.2 | 25.1 | 7.08E−01 | 2.76E+00 | 1.71E−01 | 80.6 | 1.63E+01 | 2.67E+00 | 1.61E+01 | 3.67E+00 | 1.10E−04 |
| 543 | 25 | 1.03E+00 | 3.31E+00 | 1.42E−01 | 76.6 | 2.38E+01 | 5.52E+00 | 2.32E+01 | 3.67E+00 | 1.32E−04 |
| 556.6 | 25 | 1.51E+00 | 3.98E+00 | 1.22E−01 | 71.1 | 3.40E+01 | 1.10E+01 | 3.21E+01 | 3.59E+00 | 1.59E−04 |
| 569.9 | 24.9 | 2.20E+00 | 4.79E+00 | 1.12E−01 | 63.8 | 4.69E+01 | 2.07E+01 | 4.21E+01 | 3.39E+00 | 1.92E−04 |
| 583.9 | 25 | 3.21E+00 | 5.77E+00 | 1.12E−01 | 55 | 6.16E+01 | 3.53E+01 | 5.05E+01 | 3.05E+00 | 2.31E−04 |
| 597.2 | 25 | 4.69E+00 | 6.95E+00 | 1.28E−01 | 44.7 | 7.75E+01 | 5.51E+01 | 5.45E+01 | 2.63E+00 | 2.78E−04 |
| 610.1 | 25 | 6.85E+00 | 8.38E+00 | 1.27E−01 | 34.4 | 9.13E+01 | 7.53E+01 | 5.16E+01 | 2.12E+00 | 3.35E−04 |
| 622.6 | 25 | 1.00E+01 | 1.01E+01 | 6.23E−02 | 25.4 | 1.03E+02 | 9.28E+01 | 4.41E+01 | 1.64E+00 | 4.04E−04 |

Values for $T_t$, $G_o$, and η° for the testing shown in Table 13 were 0.040243 s, 95.33521 Pa, and 3783.635 cP, respectively.

TABLE 14

| Time (sec) | Temp (° C.) | Freq. (Hz) | Stress (Pa) | Strain | Phase (°) | G* (Pa) | G' (Pa) | G'' (Pa) | Viscosity (Pa-s) | Torque (Nm) |
|---|---|---|---|---|---|---|---|---|---|---|
| 5.1 | 24.9 | 1.00E−02 | 4.16E−01 | 1.65E+00 | 88.2 | 2.52E−01 | 7.72E−03 | 2.52E−01 | 4.01E+00 | 1.66E−05 |
| 209.7 | 25.1 | 2.00E−02 | 5.47E−01 | 1.08E+00 | 89.3 | 5.07E−01 | 6.55E−03 | 5.07E−01 | 4.03E+00 | 2.19E−05 |
| 314.3 | 25 | 4.00E−02 | 7.33E−01 | 7.16E−01 | 89.3 | 1.02E+00 | 1.27E−02 | 1.02E+00 | 4.07E+00 | 2.93E−05 |
| 368.5 | 25 | 5.00E−02 | 8.07E−01 | 6.26E−01 | 89.2 | 1.29E+00 | 1.89E−02 | 1.29E+00 | 4.11E+00 | 3.23E−05 |
| 413.2 | 25 | 7.30E−02 | 9.54E−01 | 5.13E−01 | 88.9 | 1.86E+00 | 3.58E−02 | 1.86E+00 | 4.06E+00 | 3.82E−05 |
| 443.9 | 25 | 1.07E−01 | 1.13E+00 | 4.14E−01 | 88.5 | 2.74E+00 | 7.16E−02 | 2.74E+00 | 4.07E+00 | 4.52E−05 |
| 466.6 | 24.9 | 1.56E−01 | 1.35E+00 | 3.34E−01 | 88 | 4.04E+00 | 1.43E−01 | 4.04E+00 | 4.12E+00 | 5.38E−05 |
| 485 | 25.1 | 2.28E−01 | 1.61E+00 | 2.77E−01 | 87.2 | 5.80E+00 | 2.79E−01 | 5.79E+00 | 4.05E+00 | 6.42E−05 |
| 500.8 | 25.1 | 3.32E−01 | 1.92E+00 | 2.28E−01 | 86.2 | 8.43E+00 | 5.62E−01 | 8.42E+00 | 4.04E+00 | 7.68E−05 |
| 515.3 | 25.1 | 4.85E−01 | 2.30E+00 | 1.89E−01 | 84.6 | 1.22E+01 | 1.14E+00 | 1.21E+01 | 4.00E+00 | 9.20E−05 |
| 529 | 25 | 7.08E−01 | 2.76E+00 | 1.55E−01 | 82.4 | 1.79E+01 | 2.38E+00 | 1.77E+01 | 4.02E+00 | 1.10E−04 |
| 541.7 | 25 | 1.03E+00 | 3.31E+00 | 1.29E−01 | 78.9 | 2.60E+01 | 4.99E+00 | 2.55E+01 | 4.01E+00 | 1.32E−04 |
| 555.2 | 24.9 | 1.51E+00 | 3.98E+00 | 1.10E−01 | 74 | 3.74E+01 | 1.03E+01 | 3.60E+01 | 3.95E+00 | 1.59E−04 |
| 568.5 | 24.9 | 2.20E+00 | 4.79E+00 | 9.79E−02 | 67.6 | 5.22E+01 | 1.99E+01 | 4.83E+01 | 3.78E+00 | 1.92E−04 |
| 582.4 | 25 | 3.21E+00 | 5.77E+00 | 9.37E−02 | 59.3 | 7.06E+01 | 3.60E+01 | 6.07E+01 | 3.50E+00 | 2.31E−04 |
| 595.7 | 25 | 4.69E+00 | 6.95E+00 | 1.01E−01 | 49.1 | 9.10E+01 | 5.96E+01 | 6.88E+01 | 3.09E+00 | 2.78E−04 |
| 608.6 | 25 | 6.85E+00 | 8.38E+00 | 1.11E−01 | 38.7 | 1.10E+02 | 8.59E+01 | 6.88E+01 | 2.56E+00 | 3.35E−04 |
| 621 | 25 | 1.00E+01 | 1.01E+01 | 6.73E−02 | 28.7 | 1.27E+02 | 1.12E+02 | 6.12E+01 | 2.03E+00 | 4.04E−04 |

Values for $T_t$, $G_o$, and η° for the testing shown in Table 14 were 0.034184 s, 123.0668 Pa, and 4083.889 cP, respectively.

Figure 10:
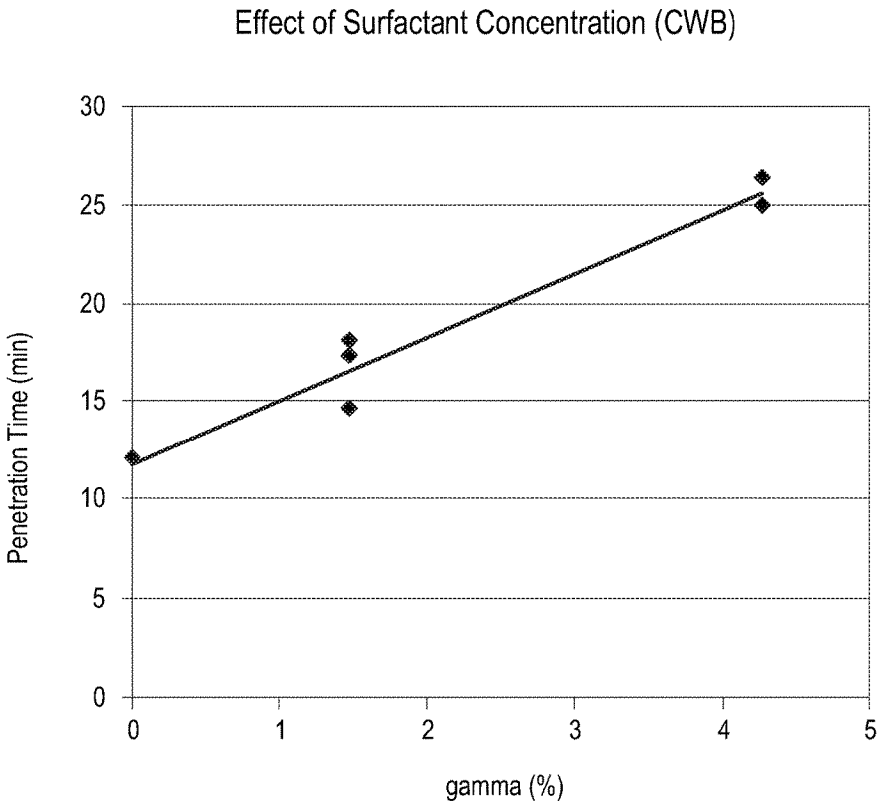
FIG. 10 plots total surfactant weight fraction (gamma) versus Corrositex™ penetration time, illustrating the effect of surfactant concentration on penetration time.

B. Decreased Dermal Corrosivity as a Result of Increased Surfactant Concentration One important negative characteristic of existing drain cleaners is their high degree of corrosivity to skin, which determines their packing group and transportation requirements for regulatory purposes. The Corrositex™ test method is an in vitro test that determines chemical corrosivity of products in lieu of animal skin testing. The test gives reproducible and reliable results, which are accepted by many federal agencies. The time a substance takes to penetrate the Corrositex™ membrane determines its degree of corrosivity. It was demonstrated that the increased surfactant concentrations (which boost the efficacy of the actives in hair clog removal performance as described herein) did not lead to an increase in corrosivity. In fact, surprisingly, inclusion of the described surfactant blends may provide a protective effect, leading to decreased dermal corrosivity. This is observed in the increased Corrositex™ penetration time with increased surfactant concentrations as shown in FIG. 9. In addition, FIG. 10 shows the effect of surfactant concentration (e.g., about 4 minutes with no surfactants as compared to about 11 to about 15 minutes with surfactant blends as described herein) on penetration time. FIG. 10 plots penetration time vs. gamma (%), where "gamma (%)" is the total weight % of surfactant for another example having compositional and physical characteristics as presented in Table 15, below. Each Formulation in Table 15 included 7.18% NaOCl and 2.2% NaOH. Again, the results show an increase in penetration time with higher levels of surfactant.

TABLE 15

| Example | Gamma (wt %) | Delta | Mean CL | ZSV (cP) | Penetration Time (min) |
|---|---|---|---|---|---|
| Ex. 15A | 0 | 0 | 0 | 1 | 12.38; 12.28 |
| Ex. 15B | 1.5 | 0.20 | 13.88 | 900 | 14.45; 17.92, 14.5; 17.27 |
| Ex. 15C | 4.5 | 0.20 | 13.88 | 3350 | 26.65; 24.95 |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A drain cleaning composition consisting of:

(a) 4% to 12% by weight of a hypochlorite oxidizing agent;

(b) greater than 3% to 10% by weight of a hydroxide;

(c) a charged surfactant which is an anionic surfactant selected from the group consisting of coconut fatty acid, sodium lauryl sulfate, alkyl benzene sulfonate, and mixtures thereof; and (d) an uncharged surfactant which is one or more amine oxides;

(e) water;

(f) optionally, one or more adjuvants selected from the group consisting of:

coloring agents, dyes, pigments, fragrances, opacifiers, corrosion inhibitors and any combinations thereof;

wherein a ratio by weight of charged surfactant to uncharged surfactant is from 1:12 to 1:50; and the composition is monophasic and viscoelastic and has a viscosity of at least 250 cP at 10/s, a zero-shear viscosity of at least 1000 cP at 25° C. and a critical shear rate of at least 1/sec.

2. The composition of claim 1, wherein the hypochlorite oxidizing agent is sodium hypochlorite.

3. The composition of claim 1, wherein the hydroxide is sodium hydroxide.

4. The composition of claim 1, wherein the ratio by weight of charged surfactant to uncharged surfactant is from 1:12 to 1:30.

5. The composition of claim 1, wherein the uncharged surfactant is two or more an amine oxides.

6. A drain cleaning composition comprising:

(a) 4% to 12% by weight of a hypochlorite oxidizing agent;

(b) greater than 3% to 10% by weight of a hydroxide;

(c) a charged surfactant selected from the group consisting of: coconut fatty acid, sodium lauryl sulfate, and alkyl benzene sulfonate and mixtures thereof;

(d) an uncharged surfactant insert which is one or more amine oxides; and (e) water;

wherein the composition is monophasic and the ratio by weight of the charged surfactant to the uncharged surfactant is from 1:12 to 1:50.

7. The composition of claim 6, wherein the hypochlorite oxidizing agent is sodium hypochlorite.

8. The composition of claim 6, wherein the hydroxide is sodium hydroxide.

9. The composition of claim 6, wherein the charged surfactant comprises a sodium lauryl sulfate.

10. The composition of claim 6, wherein the charged surfactant comprises a linear alkyl benzene sulfonate.

11. The composition of claim 6, wherein the composition has a pH of greater than 13.

12. A drain cleaning composition consisting essentially of:

(a) 4% to 12% by weight of sodium hypochlorite;

(b) greater than 3% to 10% by weight of sodium hydroxide;

(c) a charged surfactant which is an anionic surfactant selected from the group consisting of coconut fatty acid, sodium lauryl sulfate, alkyl benzene sulfonate, and mixtures thereof;

(d) an uncharged surfactant which is one or more amine oxides; and (e) water;

wherein the composition is monophasic and the ratio by weight of the charged surfactant to the uncharged surfactant is from 1:12 to 1:30 and has a pH of greater than 13.

13. The composition of claim 12, wherein a relaxation time of the composition is less than 0.1 s.

14. The composition of claim 12, wherein a zero shear viscosity of the composition is at least 1000 cP and a critical shear rate is at least 1/s.

15. The composition of claim 12, wherein a flocculation temperature of the composition is greater than 50° C.

* * * * *